United States Patent [19]

Norton

[11] 4,187,795

[45] Feb. 12, 1980

[54] DRIVE MECHANISM FOR A SEWING MACHINE PULLER WHEEL

[75] Inventor: Charlie L. Norton, Danville, Va.

[73] Assignee: Dan River Inc., Danville, Va.

[21] Appl. No.: 867,097

[22] Filed: Jan. 5, 1978

[51] Int. Cl.[2] ..... D05B 27/10; D05B 27/04; D05B 27/12; D05B 27/14

[52] U.S. Cl. ..... 112/318; 112/320; 112/322

[58] Field of Search ..... 112/203, 210, 211, 214, 112/320, 322, 303

[56] References Cited

U.S. PATENT DOCUMENTS

| | | | |
|---|---|---|---|
| 775,471 | 11/1904 | Johnson | 112/211 UX |
| 2,254,779 | 9/1941 | Myers | 112/214 |
| 2,521,360 | 9/1950 | Gerstein | 112/214 |
| 2,583,735 | 1/1952 | Hayes | 112/214 |
| 2,586,764 | 2/1952 | Nelson | 112/211 |
| 3,003,443 | 10/1961 | Condran | 112/214 |
| 3,071,089 | 1/1963 | Reeber | 112/214 |
| 3,104,639 | 9/1963 | Reeber | 112/214 |
| 3,417,718 | 12/1968 | Andersson | 112/214 X |
| 3,435,790 | 4/1969 | Hale | 112/214 |
| 3,472,187 | 10/1969 | Kaplan et al. | 112/214 |
| 3,948,195 | 4/1976 | Chudner | 112/214 |
| 3,960,097 | 6/1976 | Block | 112/214 |
| 4,065,043 | 12/1977 | Ohashi | 112/211 |

*Primary Examiner*—Ronald Feldbaum
*Attorney, Agent, or Firm*—Fisher, Christen & Sabol

[57] ABSTRACT

A mechanism is disclosed for driving a puller wheel to assist in feeding cloth material through a sewing machine. The material passes between a puller wheel and an idler wheel after having been sewn by a reciprocating needle. The driven puller wheel assists the standard feed dogs in feeding the material past the needle. The invention discloses a positive drive mechanism having a variable speed gearbox driven by the sewing machine motor and drivingly connected to the puller wheel. The distance between puller wheel and idler wheel is variable to accommodate any thickness of material and still provide a positive feed.

4 Claims, 3 Drawing Figures

DRIVE MECHANISM FOR A SEWING MACHINE PULLER WHEEL

1. Field of the Invention

The present invention relates to mechanical drive mechanisms, more particularly such mechanisms associated with a sewing machine to assist in feeding the material therethrough.

2. Background of the Invention

Sewing machine structures and feeding mechanisms therefor have taken innumerable configurations over the years since their initial conceptions. Today, the general configuration of the sewing machine has become more or less standard and comprises a vertically reciprocal needle assembly being driven by a shaft passing laterally through the machine head and terminating in a handwheel. Typically, the handwheel and shaft are rotated via a V-belt connection with an electric motor.

Virtually all sewing machines today also have some means to move the material past the needle as it reciprocates. Typically, this takes the form of "feed dogs", i.e., elongated members located beneath the needle having serrated upper surfaces and moving in a generally rectangular path such that the serrated surface engages the fabric material and moves it toward the needle. The drive mechanism for the "feed dogs" is interconnected with the needle assembly drive mechanism so that the "feed dogs" do not push the material while it is in contact with the needle.

In sewing machines used by an individual in the home for hobby or enjoyment purposes, the aforedescribed mechanism has proven generally satisfactory. However, in sewing machines, for industrial or commercial use the great variety of material types and sizes which must be sewn has generally rendered the aforedescribed mechanism time consuming and, generally unreliable. Many attempts have been made to provide an auxiliary feed mechanism used in conjunction with the "feed dog" type mechanism. These attempts have generally involved the use of a pair of wheels engaging the cloth material therebetween, one of the wheels being driven so as to impart motion to the material, along with the "feed-dog", when the needle is withdrawn. Exemplary showings of such auxiliary feed wheels are found in U.S. Pat. Nos. 2,777,049; 3,018,746; 3,413,943; and 3,964,410. Almost all of these exemplary devices rely on flexible shafts or couplings to transmit rotational force from the sewing machine drive to the driven wheel or wheels. The force of the presser foot on the material overcomes the driving force of the wheels during that portion of the operational cycle when the "feed-dog" is out of contact with the material. When the "feed-dog" pushes the material, the driven wheel, which also engages the material, rotates to assist in the material feed. However, the flexible shaft or coupling is directly connected to a rotational power input and must absorb the torsional forces when the drive wheel is held stationary by lack of material movement. This of course, induces great stress in the flexible shaft and, when taken in context of the heavy usage of an industrial or commercial machine, results in many broken or deformed shafts. The net result is an unacceptable amount of inoperable periods.

Another deficiency of such prior art is that all depend upon a variable diameter pulley to vary the speed of the driven wheel or wheels. This necessitates shutting down the sewing machine in order to adjust the speed of the auxiliary feed wheel. Again, this is unacceptable in a commercial or industrial application where lost time equals lost profits.

Another prior art mechanism uses a rotating shaft, driven by the sewing machine motor to drive an eccentric crank which, in turn, drives the auxiliary puller wheel. The eccentric crank movement and, consequently, the speed of the puller wheel is adjustable by varying the position of the connection to the shaft radially from the shafts' center line. Positioning the connection on the center would produce no wheel movement, while positioning it at the maximum radius of the shaft would produce maximum wheel movement. This mechanism has proven troublesome insofar as it is necessary to shut down the sewing machine in order to adjust the speed of the puller wheel and insofar as the motion of the crank mechanism causes increased wear of the puller wheel support bearings.

A deficiency of the prior art devices is their inability to reliably function when the material having a great variation in thickness has to be sewn. This is particularly true in the fabrication of fitted sheets or the like. The operation of sewing the corners and inserting the requisite elastic strip entails the sewing of cloth having a thickness of from two layers up to eight or ten layers thick. Heretofore, the puller wheels have either slowed down, stopped completely, or slipped when faced with the thicker materials.

Other U.S. patents which typify the state of the sewing machine art are as follows: U.S. Pat. Nos. 3,199,479; 3,213,814; 3,295,484; 3,349,734; 3,442,236; 3,777,314; 3,848,555; 3,893,402; 3,964,410; and 3,994,246.

SUMMARY OF THE INVENTION

The present invention discloses a puller wheel drive mechanism that obviates the deficiencies of the prior art devices and provides an economical system that will reliably function regardless of material thickness. The mechanism comprises a variable speed gearbox having its input shaft driven by a toothed belt connected to the sewing machine drive. The gearbox output ratio is variable by manually moving a lever located externally of the gearbox casing. The output shaft of the gearbox is connected to one end of a rigid driveshaft via a universal joint coupling. The opposite end of the shaft is connected to a toothed pulley via a similar universal joint coupling. The toothed pulley is rotatably attached to a yoke assembly which also rotatably supports a puller wheel. The puller wheel is driven by a toothed belt connection with the aforementioned toothed pulley. An idler puller wheel is rotatably attached to the machine base and is disposed below the driven puller wheel. Both puller wheels have serrations on their peripheries to provide a positive grip on the cloth material.

A piston rod of a pneumatic cylinder is connected to the yoke assembly such that extension or retraction of the piston rod lowers or raises the yoke assembly and, consequently alters the distance between the driven puller wheel and the idler puller wheel. This allows various thicknesses of material to be accommodated without affecting the driving capability of the puller wheel assembly. The universal couplings allow the rotational force to be transmitted to the driven pulley wheel even during the vertical adjustment of the yoke assembly.

DETAILED DESCRIPTION OF THE PREFERED EMBODIMENT

Figure 1:
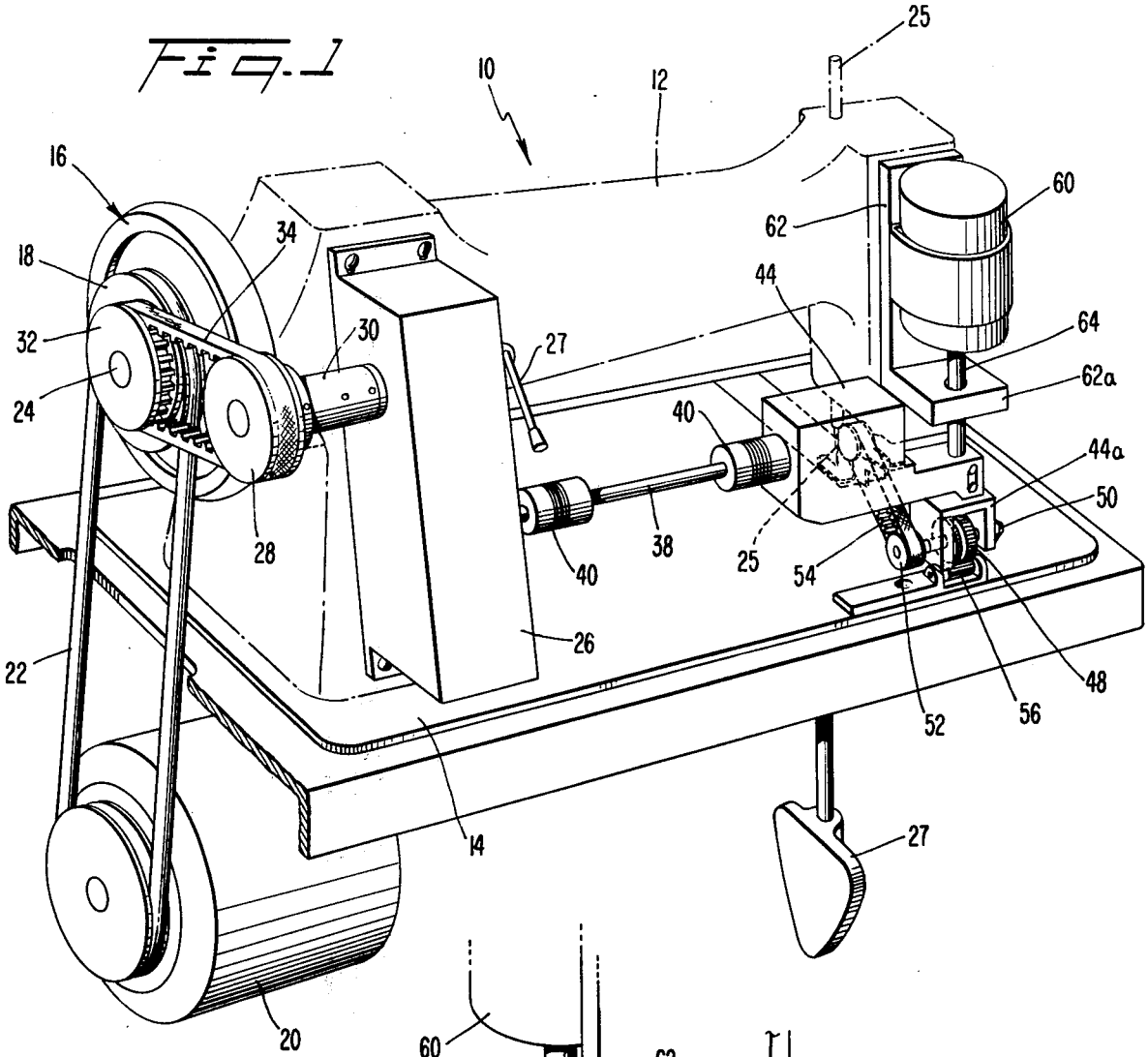
FIG. 1 is a perspective view of a mechanism according to the invention attached to a sewing machine.
Figure 2:
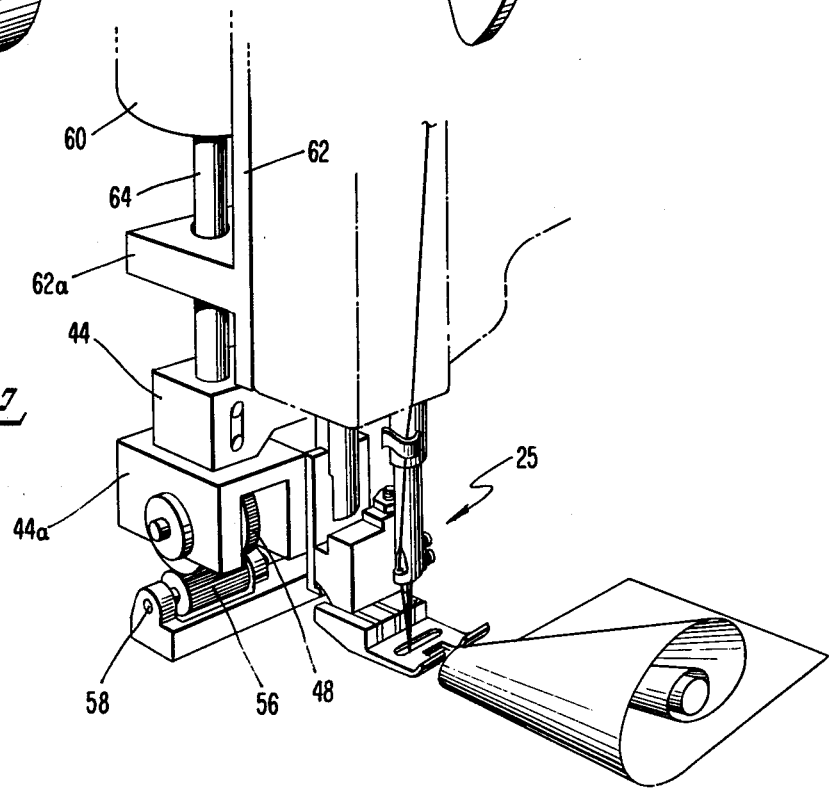
FIG. 2 is a partial perspective view of the puller wheels of the mechanism of FIG. 1.
Figure 3:
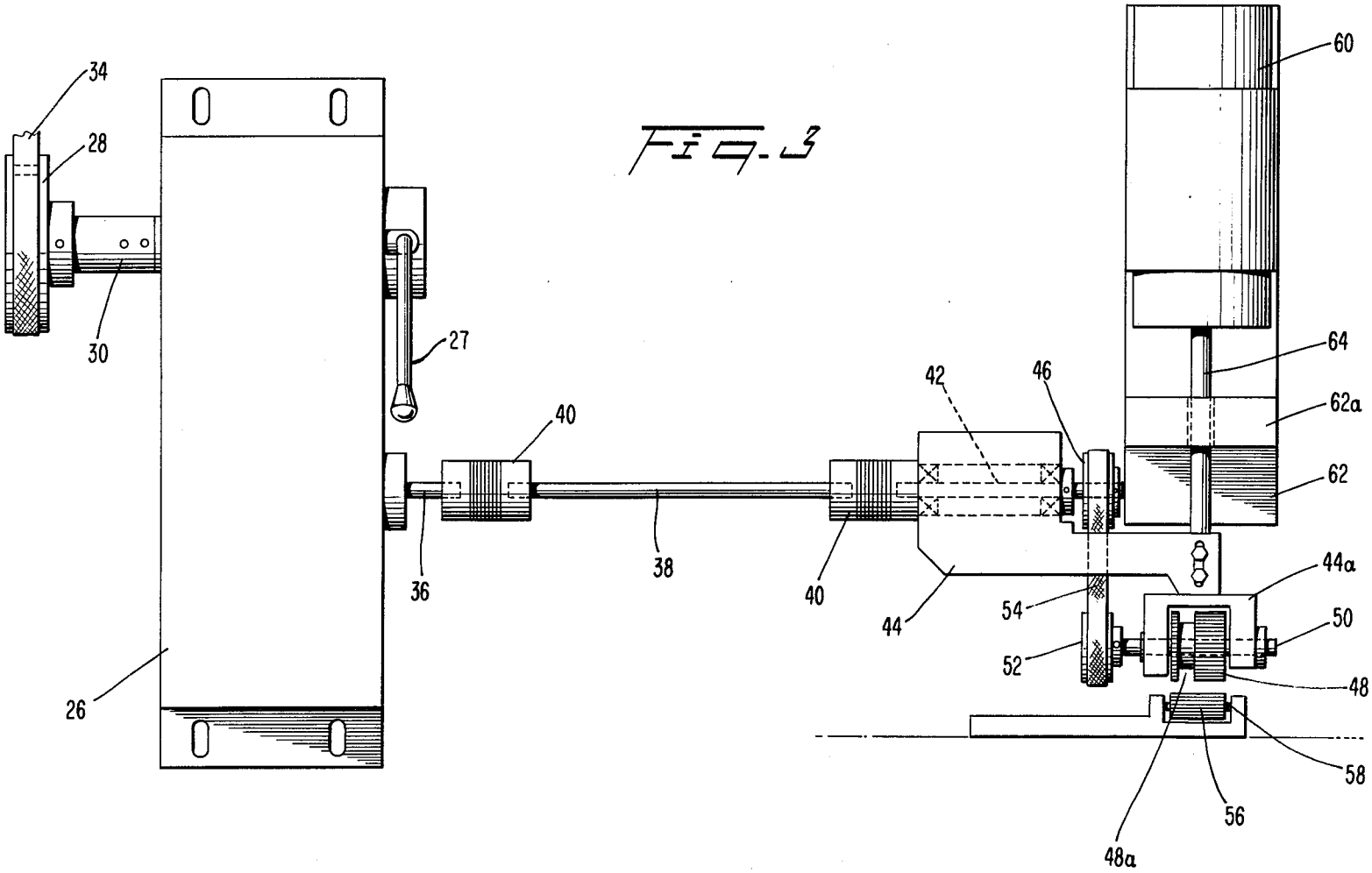
FIG. 3 is a view in elevation of the puller wheel mechanism shown in FIG. 1.

The puller wheel drive mechanism according to the present invention is shown in FIG. 1 associated with a conventional sewing machine, indicated generally by 10, having a machine body 12 and a base 14. Base 14 may be attached to a table or the like such that the operator may comfortably operate the machine while in a seated position. Machine body 12 has drive portion 16 wherein pulley wheel 18 is drivingly connected to motor 20 via belt-drive 22. As is well known, pulley wheel 18 is connected to main drive shaft 24 which extends laterally through machine body 12 and is connected to needle assembly 25 so as to cause needle assembly 25 to reciprocate vertically. The operation of motor 20 is controlled by known foot switch means (not shown) or a knee actuated switch 27. The foregoing is a basic description of known sewing machine structure and the details of the thread supply, hemming scrolls and other accessories are omitted for the sake of clarity. Suffice to say, the instant invention may be used with any conventional sewing machine apparatus possessing the basic elements described above. Variable speed gearbox 26 is mounted to the rear portion of machine body 12. Alternatively, gearbox 26 may be mounted on base 14 adjacent drive portion 16. Gearbox 26 may be any type wherein the output ratio is adjustable by means extending externally of the gearbox such as the control handle 27. The gearbox manufactured by Zero-Max Industries, Minneapolis, Minnesota has been found to be particularly well suited for this specific application. Toothed pulley 28 is attached to input shaft 30 of gearbox 26 and is drivingly connected to a similar toothed pulley 32 via toothed belt 34. Toothed pulley 32 is drivingly connected to main drive shaft 24 such that the rotation of such shaft is transferred to gearbox input shaft 30.

Gearbox output shaft 36 is connected to puller wheel driveshaft 38 via spring type universal joint coupling 40. A similar spring type universal joint coupling is used on the other end of driveshaft 38 to connect it with pulley shaft 42. Universal joint couplings 40 transmit rotational forces, and allow angular and lateral displacement of the interconnected shafts without loss of rotational power transmission. Universal couplings manufactured by Helical Products Co. of Santa Maria, Calif. have been found to be well suited, but any other type of universal coupling may be used without exceeding the scope of the invention.

Pulley shaft 42 is rotatably supported in yoke, assembly 44 and has toothed pulley 46 attached to one end. Yoke assembly 44 also includes "U" shaped support portion **44*a* which rotatably supports puller wheel 48 via shaft 50. Shaft 50 extends beyond one of the legs of the support portion 44*a* and has toothed pulley 52 attached thereto. Toothed belt 54 connects toothed pulley 52 with toothed pulley 46 to impart a driving rotation to puller wheel 48**.

Idler puller wheel 56 is rotably supported by shaft 58 mounted on base 14 and is disposed directly below driven puller wheel 48. Both puller wheels 48 and 56 have knurled or serrated peripheries to prevent slippage on the cloth material engaged therebetween. Driven puller wheel 48 has a groove **48*a*** in its periphery so as to provide clearance for bulky seams and the like.

Pneumatic cylinder 60 is mounted on bracket 62 which, in turn, is mounted on the rear portion of machine body 12 near needle assembly 25. Alternatively, bracket 62 may be attached to base 14 without exceeding the scope of this invention. Piston rod 64 of pneumatic cylinder 60 slidably passes through support portion **62*a* of bracket 62 and is attached to yoke assembly 44. Pneumatic cylinder 60 is connected to a source of air pressure (not shown) via known control valve means (not shown) such that piston rod 64 may be extended or retracted to move yoke assembly 44 up or down to vary the vertical position of puller wheel 48. This serves to adjust the pressure on the fabric material between puller wheels 48 and 56**.

Thus, it can be seen that the sewing machine motor 20 transmits rotational movement to driven puller wheel 48 via the aforedescribed mechanism. When the sewing machine is turned on, the operator initially feeds the material under the reciprocating needle assembly 25 assisted by conventional "feed-dog" mechanisms (not shown) in the throat plate. As the material passes by needle assembly 25 it is engaged between puller wheels 48 and 56, which then pull the material such that the operator need only guide the material. The pulling speed of the puller wheel is sufficiently slow, as compared to the very rapid needle reciprocating speed, that the pull by the wheels on the fabric may be exerted constantly. The distance moved by the fabric material during the short amount of time that the needle actually extends through the material is sufficiently small that no danger of needle breaking or bending exists.

We claim:

1. A puller wheel drive mechanism for use in association with a sewing machine having a pedestal provided with a horizontally projecting arm spaced above a work surface sufficiently to allow unobstructed movement beneath said arm of material being sewed, said arm supporting a reciprocable needle and presser foot assembly at a distance from the pedestal and a horizontal main shaft connected with a motor to drive said needle assembly, said drive mechanism comprising:

(a) a variable speed gearbox positioned behind said pedestal having an input shaft, an output shaft, and external control means to vary the rotational speed of the output shaft with respect to the rotational speed of the input shaft;

(b) toothed endless belt and pulley means drivingly connecting said input shaft to said main shaft;

an idler puller wheel rotatably mounted at the level of said work surface and behind said reciprocable needle assembly;

(d) a yoke assembly having a driven puller wheel disposed above said idelr puller wheel;

(e) second drive means drivingly connecting said output shaft to said driven puller wheel comprising horizontal flexible shaft means connected at one end with said output shaft of the gearbox and supported at the other end by said yoke assembly at a distance above said work surface sufficiently to allow unobstructed movement of sewed material beneath said shaft, and toothed endless belt and pulley means drivingly connecting said driven puller wheel with the other end of said shaft and (f) pneumatic means to raise and lower said yoke assembly including said driven puller wheel independently of said reciprocable presser foot assembly.

2. The puller wheel drive mechanism of claim 1, wherein said flexible shaft means comprises a plurality of rigid shaft sections joined to each other by universal joint means.

3. The puller wheel drive mechanism of claim 1, wherein said driven puller wheel is provided with a serrated peripheral surface.

4. The puller wheel drive mechanism of claim 1, wherein said driven puller wheel is provided with an annular groove to provide clearance for bulky seams.

* * * * *